US008366221B2

(12) United States Patent
Kim et al.

(10) Patent No.: US 8,366,221 B2
(45) Date of Patent: Feb. 5, 2013

(54) DOOR ASSEMBLY AND REFRIGERATOR HAVING THE SAME

(75) Inventors: Ung-Su Kim, Gyeongsangnam-Do (KR); Bon-Young Koo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 339 days.

(21) Appl. No.: 12/742,687

(22) PCT Filed: Nov. 6, 2008

(86) PCT No.: PCT/KR2008/006542
§ 371 (c)(1),
(2), (4) Date: May 13, 2010

(87) PCT Pub. No.: WO2009/064090
PCT Pub. Date: May 22, 2009

(65) Prior Publication Data

US 2010/0270901 A1 Oct. 28, 2010

(30) Foreign Application Priority Data

Nov. 15, 2007 (KR) ..... 10-2007-0116866

(51) Int. Cl.
*A47B 96/00* (2006.01)

(52) U.S. Cl. ..... 312/405

(58) Field of Classification Search ..... 312/401, 312/405, 406, 406.1, 406.2, 204, 257.1, 263, 312/265.5; 62/440
See application file for complete search history.

(56) References Cited

U.S. PATENT DOCUMENTS

| | | | | | |
|---|---|---|---|---|---|
| 3,940,195 | A * | 2/1976 | Tillman | ..... | 312/406.1 |
| 4,644,698 | A * | 2/1987 | Gerdes et al. | ..... | 49/478.1 |
| 4,821,399 | A * | 4/1989 | Markley et al. | ..... | 29/458 |
| 5,358,326 | A | 10/1994 | Cherry et al. | | |
| 8,104,853 | B2 * | 1/2012 | Kim et al. | ..... | 312/405 |
| 2005/0006997 | A1 * | 1/2005 | Yoshioka | ..... | 312/405 |
| 2008/0036350 | A1 * | 2/2008 | Crompton et al. | ..... | 312/405 |

FOREIGN PATENT DOCUMENTS

| | | | |
|---|---|---|---|
| CN | 1629573 | A | 6/2005 |
| KR | 10-2007-0076990 | A | 7/2007 |
| KR | 10-0766057 | B1 | 10/2007 |
| WO | WO 2005/078365 | * | 8/2005 |

* cited by examiner

*Primary Examiner* — James O Hansen
(74) *Attorney, Agent, or Firm* — Birch, Stewart, Kolasch & Birch, LLP

(57) ABSTRACT

The present invention relates to a door assembly and refrigerator having the same. The door assembly according to the present invention includes a door main body, a panel disposed on a front surface of the door main body, and a side cover coupled at least one of a left side portion and a right side portion of the door main body and supporting the panel, wherein the side cover is provided with screw coupling portions concaved from an external surface and protruded from an inner surface along an insertion direction of screws and screw holes formed by penetrating the screw coupling portions, and the door main body is provided with inference-avoiding space portions for receiving the screw coupling portions therein. Accordingly, it is capable of preventing inferiority of the side cover and of reducing the amount of used materials.

15 Claims, 6 Drawing Sheets

[Fig. 1]
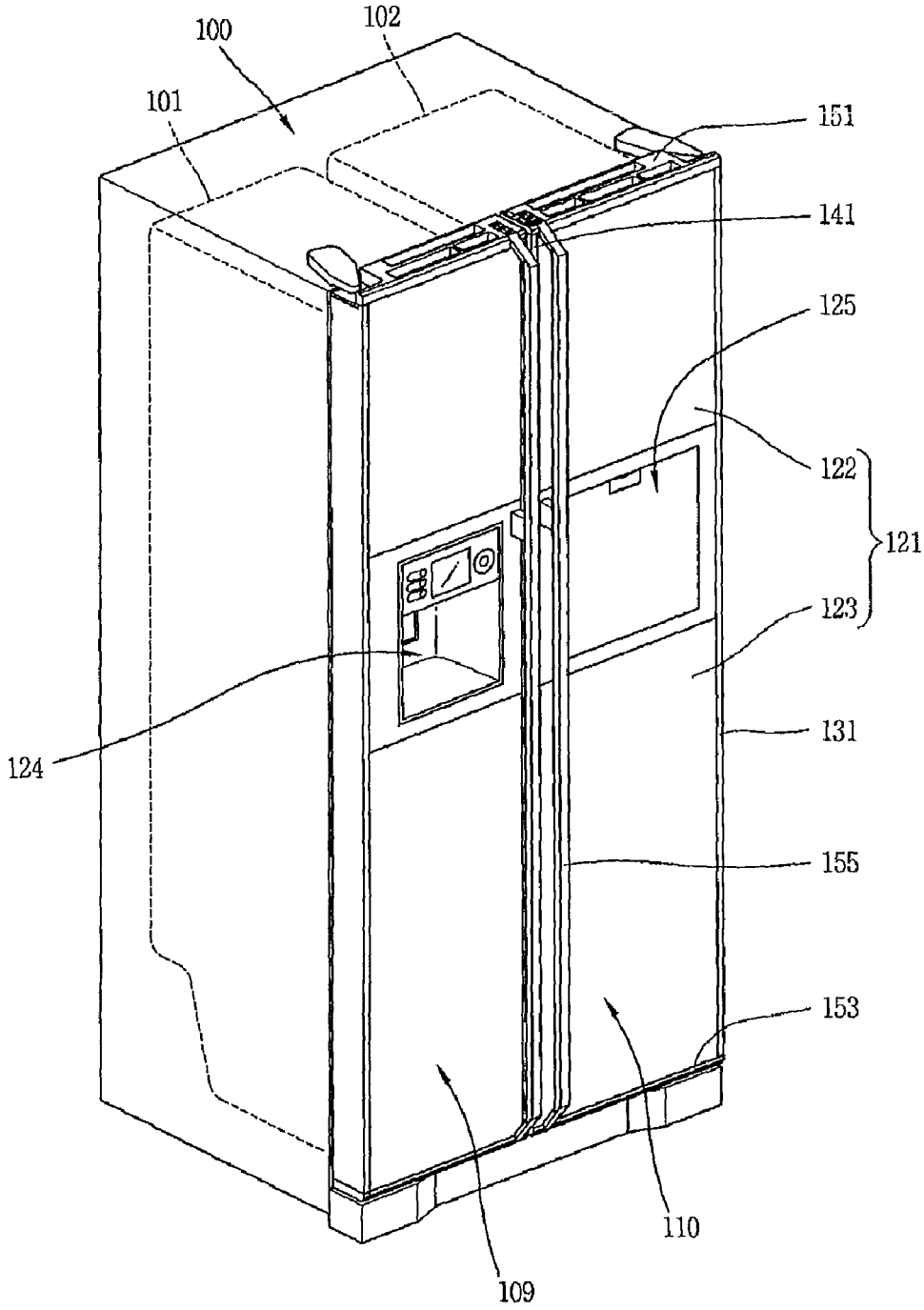

[Fig. 2]
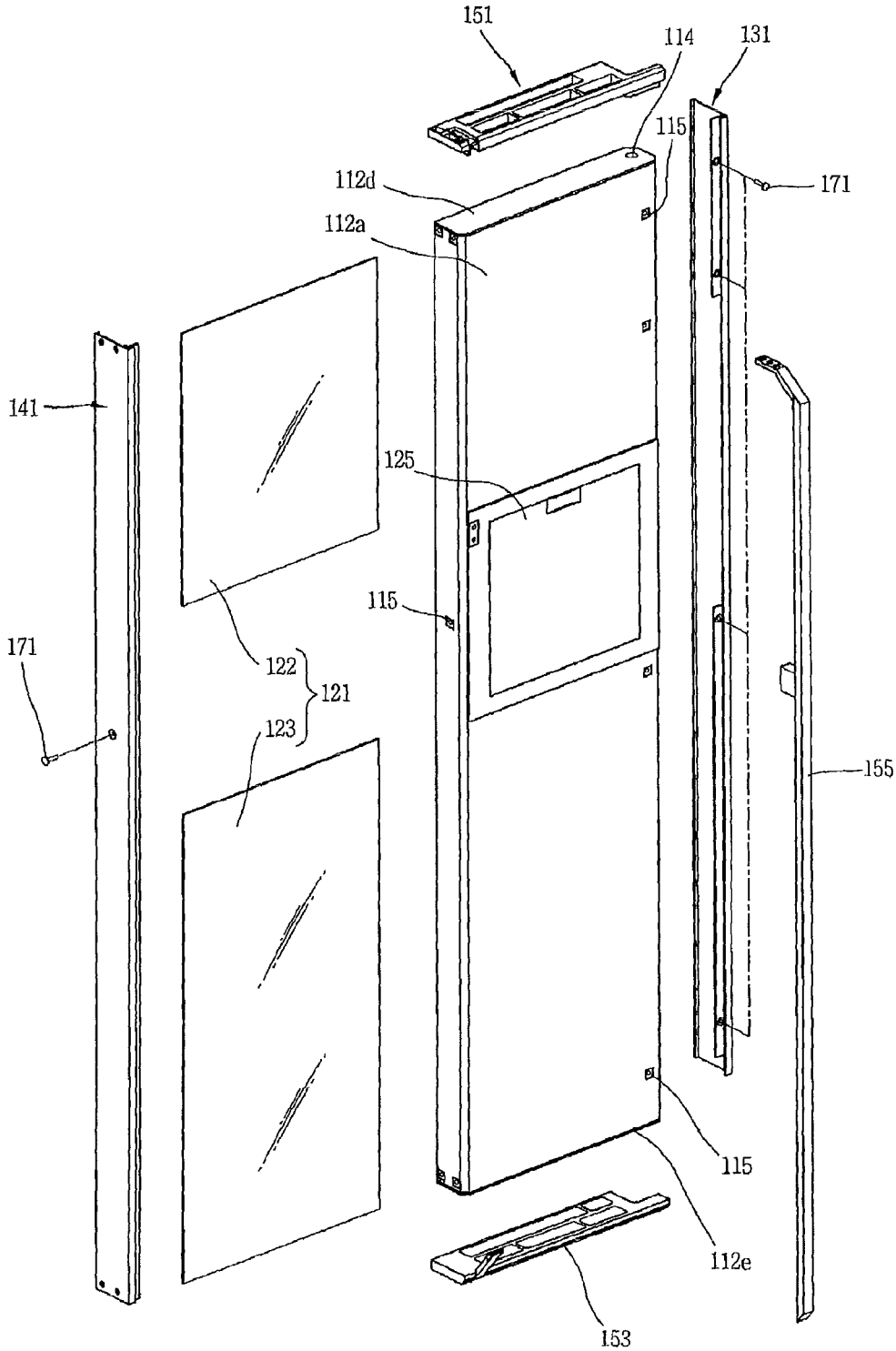

[Fig. 3]
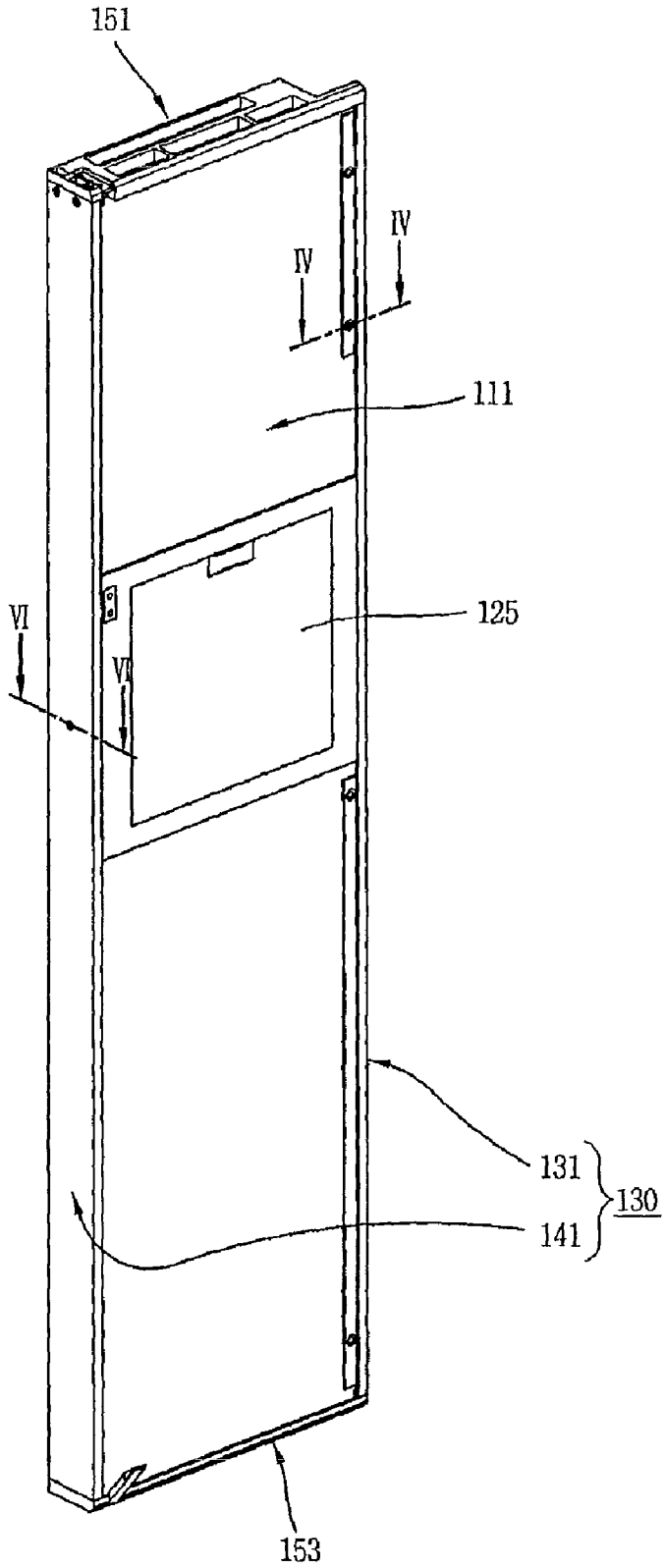

[Fig. 4]
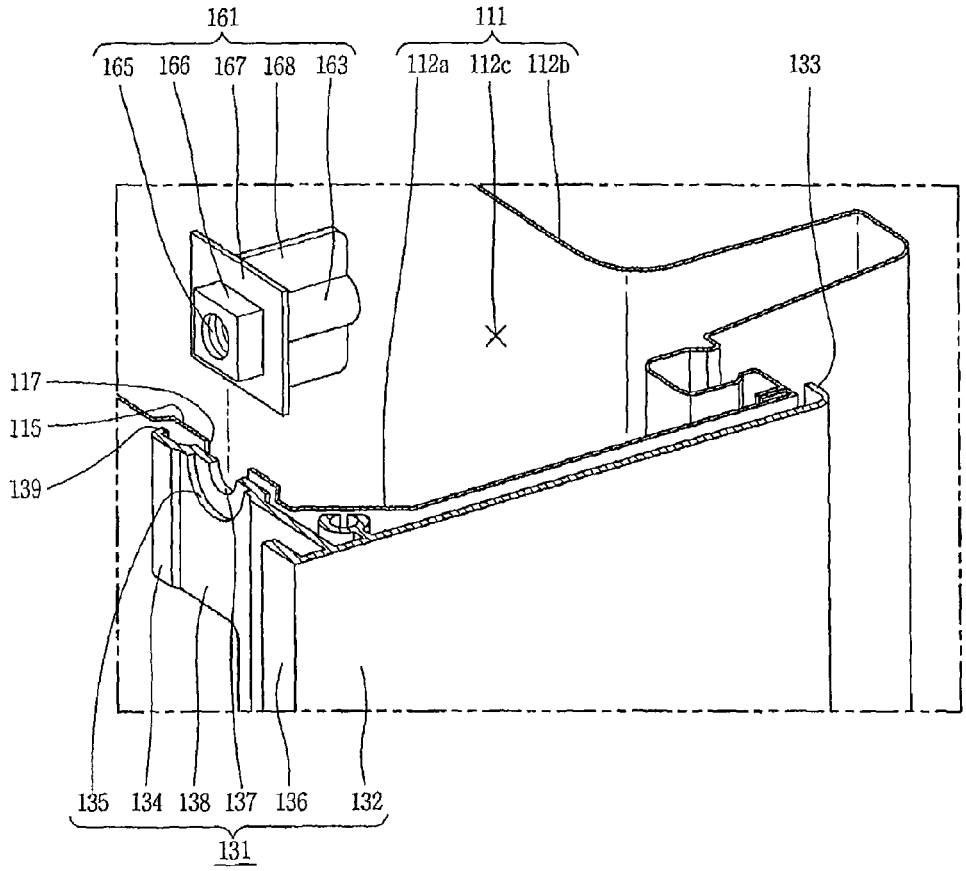
[Fig. 5]
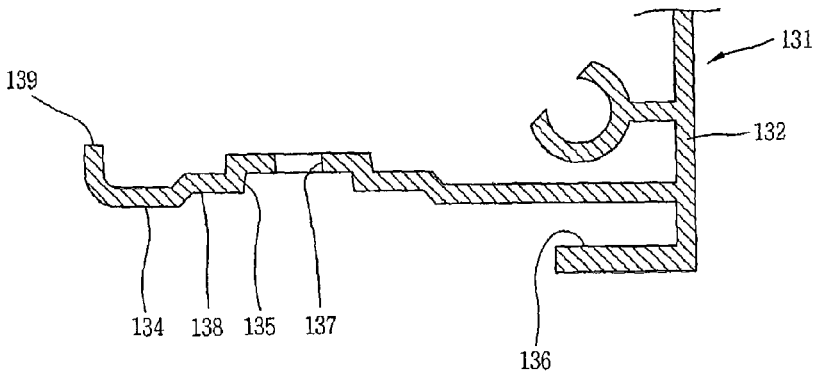

[Fig. 6]
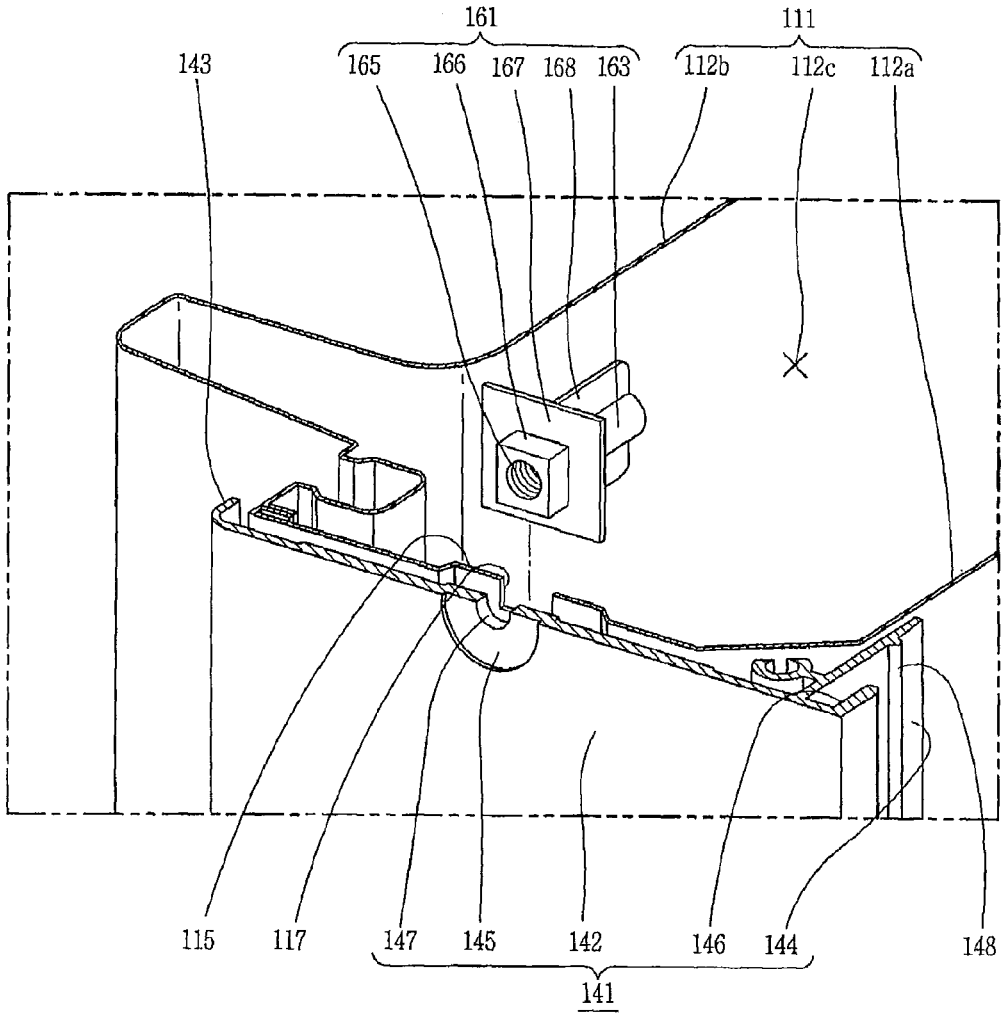

[Fig. 7]
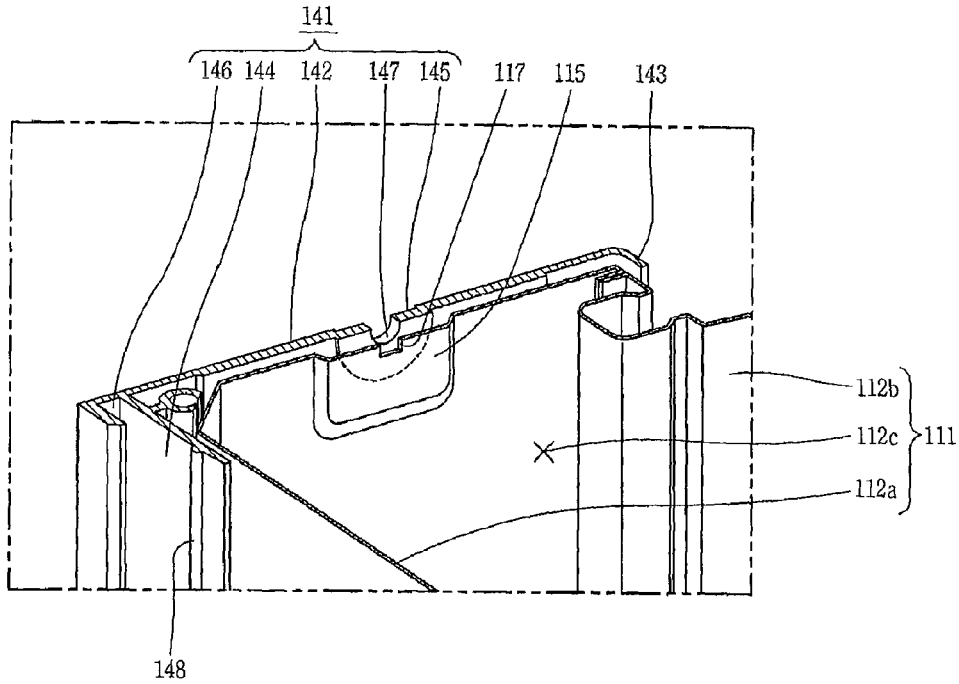
[Fig. 8]
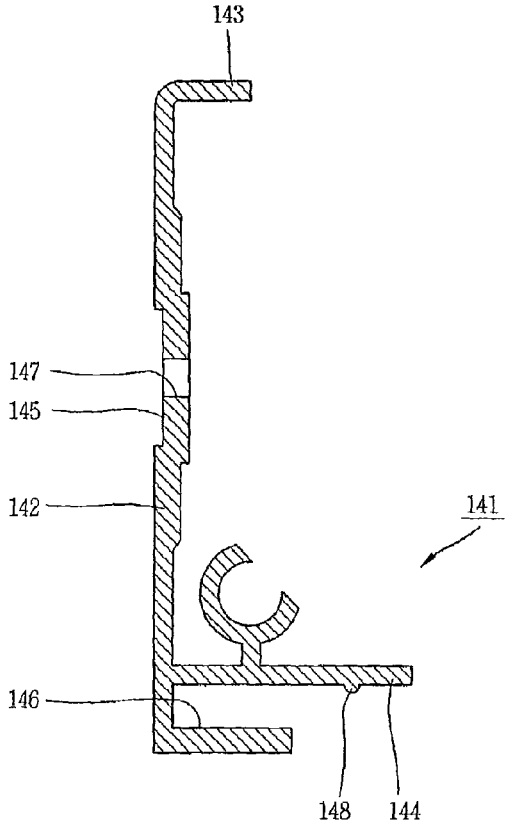

DOOR ASSEMBLY AND REFRIGERATOR HAVING THE SAME

TECHNICAL FIELD

The present invention relates to a door assembly and a refrigerator having the same, and more particularly, to a door assembly which is capable of preventing inferiority of a panel coupled to a front surface of a door main body and a refrigerator having the same.

BACKGROUND ART

As well known, a refrigerator serves to store food items therein in a cool state and includes a refrigerator main body having a cooling chamber, a door for opening and closing the cooling chamber, and a refrigerating cycle for supplying cool air to the cooling chamber.

The door includes an outer case forming an external appearance, an inner case disposed in the outer case with a filling space for a foaming agent and door caps respectively disposed at an upper end and a lower end of the outer case and the inner case.

However, the door of the refrigerator according to the related art has a problem that it is easily marked and scratched since the outer case is implemented as a metallic member coated with paint. Thus, a door assembly configured by disposing a panel implemented as a transparent stiff member such as a glass member on a front surface of the outer case is currently used so as to solve the abovementioned problem.

In order to support the panel, the door assembly may include an upper cover and a lower cover respectively coupled to an upper end portion and a lower end portion of the door main body and side covers respectively coupled to a left side portion and a right side portion of the door main body. The side covers are coupled to the door main body using a plurality of screws.

The side covers are provided with screw head receiving portions in a concave shape so as to prevent head portions of the screws from being protruded from surfaces of the side covers. The screw head receiving portions may be generally formed using a drill.

However, in the door assembly according to the related art, the screw head receiving portions should be formed one by one by an operator in a cutting manner such as a drilling manner so as for the head portions of the screws to be received in the side covers, thereby increasing a fabrication time.

And, peripheral portions of screw holes should be cut in a thickness direction so as to form the screw head receiving portions, which may cause the side covers to be thicker as much as the peripheral portions are cut. Accordingly, materials for fabricating the side covers may be increased.

Also, size variation may largely occur depending on skillfulness of the operator for the screw head receiving portions, operation environment, etc, which may cause inferiority of the side covers. That is, if each depth of the screw head receiving portions is greater, strength of the screw head receiving portions may decrease.

On the other hand, if each depth of the screw head receiving portions is lower, the head portions of the screws may be outwardly protruded. In this case, the protruded heads may contact with peripheral items, which causes inferiority such as scratch. Concretely, when the screw head receiving portions are formed on a front surface of the door main body of the side covers, the protruded screw head portions may contact with the panel and scratch the surface of the panel, thereby causing inferiority of the panel.

DISCLOSURE OF INVENTION

Technical Problem

Therefore, it is an object of the present invention to provide a door assembly which is capable of reducing inferiority.

It is another object of the present invention to provide a door assembly which is capable of preventing a panel from being scratched at a time of coupling of the panel.

It is still another object of the present invention to provide a door assembly which is capable of reducing an amount of materials by excluding a cutting operation.

Technical Solution

To achieve the object, in accordance with one aspect of the present invention, there is provided a door assembly comprising a door main body, a panel disposed on a front surface of the door main body, and a side cover coupled at least one of a left side portion and a right side portion of the door main body and supporting the panel. The side cover may be provided with screw coupling portions concaved from an external surface and protruded from an inner surface along an insertion direction of screws and screw holes formed by penetrating the screw coupling portions. The door main body may be provided with inference-avoiding space portions for receiving the screw coupling portions therein.

Here, the door assembly may further comprise female screw members disposed at each rear side of the interference-avoiding space portions and to which the screws are coupled.

The female screw members may be respectively provided with coupling portions so as to be coupled to the interference-avoiding space portions, and the interference-avoiding space portions may be respectively provided with receiving holes so as to receive the coupling portions.

The female screw members may be respectively provided with at least one rotation preventing portion protruded in a horizontal direction with respect to an axial line direction.

The female screw members may be respectively provided with flanges coming into contact with each rear surface of the interference-avoiding space portions.

The side cover may comprise a first side cover disposed at a side surface portion of a hinge portion side of the door main body and a second side cover disposed at an opposite side of the first side cover.

The first side cover may be provided with front flanges disposed on the front surface of the door main body.

The screw coupling portions may be formed at the front flanges.

The front flanges may be configured to have end portions curved toward the door main body.

The first side cover may be provided with panel supporting portions disposed at each front side of the front flange and supporting the panel.

The side cover may be formed of a metallic member.

Here, the screw coupling portions may be formed in a pressing manner.

The side cover may be formed in an extruding manner.

The second side cover may comprise a body disposed at the side surface portion of the door main body and front flanges disposed on the front surface of the door main body. And, the screw coupling portions may be formed at the body.

The second side cover may be provided with panel supporting portions disposed at the front side of the front flanges and supporting the panel.

The screw coupling portions may be formed at concaved portions more concaved toward the door main body than peripheral portions thereof.

In accordance with another aspect of the present invention, there is provided a refrigerator having a door assembly, the refrigerator comprising a refrigerator main body having a cooling chamber therein and the door assembly disposed on a front surface of the refrigerator main body so as to open and close the cooling chamber.

Advantageous Effects

As aforementioned, according to the present invention, heads of the screws are not outwardly protruded, accordingly it is capable of preventing inferiority of the panels such as scratching when coupling the panels.

Also, according to the present invention, the cutting operation for inserting the heads of the screws can be excluded, accordingly it is required to increase the thickness of the side cover so as to perform the cutting operation, thereby reducing the amount of used materials.

And, according to the present invention, the cutting operation for inserting the heads of the screws can be excluded, accordingly it is capable of preventing the side cover being inferior with respect to a size which may be caused by the cutting operation.

And, according to the present invention, the concaved portions are formed at the side cover to be concaved toward the door main body, the screw coupling portions are formed at the concaved portions to be concaved from the external surface and to be protruded from the inner surface and the screw holes are penetratingly formed at the screw coupling portions, accordingly it is capable of stably supporting the panels and of configuring the heads of the screws to be sufficiently spaced from the panels, thereby remarkably reducing the scratching inferiority of the panels.

BRIEF DESCRIPTION OF THE DRAWINGS

In the drawings:

FIG. 1 is a perspective view showing a refrigerator having a door assembly in accordance with one embodiment of the present invention;

FIG. 2 is a perspective view showing a disassembled state of the door assembly of FIG. 1;

FIG. 3 is a perspective view showing an assembled state of a panel of FIG. 2 before it is coupled;

FIG. 4 is a perspective view taken along line IV-IV in FIG. 3;

FIG. 5 is a planar view showing a front flange in FIG. 4;

FIG. 6 is a perspective view taken along line VI-VI in FIG. 3;

FIG. 7 is a perspective view showing inside of a second side cover of FIG. 6; and FIG. 8 is a planar view showing the second side cover of FIG. 6.

MODE FOR THE INVENTION

Hereafter, description will now be given in detail of one embodiment of door assemblies and a refrigerator having the same according to the present invention with accompanying drawings.

As shown in FIG. 1, a refrigerator having a door assembly according to the present invention includes a refrigerator main body 100 having a cooling chamber therein, and door assemblies 109, 110 by which the cooling chamber is opened and closed. Here, the cooling chamber indicates a freezing chamber and a refrigerating chamber, and the refrigerator main body 100 may be provided with one of the freezing chamber and the refrigerating chamber. The refrigerator main body 100 may be provided with the freezing chamber and the refrigerating chamber formed in right and left directions. However, the refrigerator main body 100 may also be implemented as a top freezer type refrigerator or a bottom freezer type refrigerator in which the freezing chamber and the refrigerating chamber are formed in upper and lower directions.

The freezing chamber 101 and the refrigerating chamber 102 are respectively formed in the refrigerator main body 100 in right and left directions. And, the door assemblies 109, 110 are respectively formed on a front surface of the refrigerator main body 100 so as to open and close the freezing chamber 101 and the refrigerating chamber 102.

The door assembly 109 for opening and closing the freezing chamber 101, that is, the door assembly 109 disposed at a left side on the drawing, may have a front surface provided with a dispenser 124 through which water and/or ice cubes are discharged out without opening the freezing chamber 101.

And, the door assembly 110 for opening and closing the refrigerating chamber 110 may have a front surface provided with a home bar 125 for receiving and drawing out foods without entirely opening the refrigerating chamber 102.

Since the door assembly 109 for opening and closing the freezing chamber 101 has a configuration similar to that of the door assembly 110 for opening and closing the refrigerating chamber 102, the door assembly 110 for opening and closing the refrigerating chamber 102 will be explained as an example, hereafter.

The door assembly 110, as shown in FIGS. 1 to 3, includes a door main body 111, a panel 121 disposed at a front surface of the door main body 111, and a side cover 130 coupled to at least one of left side portion and right side portion of the door main body 111 and supporting the panel 121. The side cover 130 includes screw coupling portions 135, 145 concaved with respect to an external surface and protruded with respect to an inner surface along an insertion direction of screws 171 and screw holes 137, 147 penetrating the screw coupling portions 135, 145. Here, the door main body 111 is configured to open and close the refrigerating chamber 102.

The door main body 111 includes an outer case 112*a* forming an external appearance, an inner case 112*b* disposed in the outer case 112*a* with a filling space 112*c* for a foaming agent, and an upper cap 112*d* and a lower cap 112*e* disposed to respectively cover upper ends and lower ends of the outer case 112*a* and the inner case 112*b*.

Shaft receiving portions 114 are formed at each one side of the upper can 112*d* and the lower cap 112*e* so as to receive hinge shafts formed at the refrigerator main body therein. In this embodiment, the shaft receiving portions 114 are respectively formed at right end portions of the upper can 112*d* and the lower cap 112*e*, and correspondingly, the upper cover 151 and the lower cover 153 corresponding to the left end portions of the upper cap 112*d* and the lower cap 112*e* are respectively coupled to an upper end and a lower end of a handle 155 by which the door main body 111 can be opened and closed.

The home bar 125 is formed at a middle portion of the door main body 111. The panel 121 includes a first panel 122 and a second panel 123 respectively disposed at an upper side and a lower side of the home bar 125. Here, if the home bar 125 is not installed, the panel 121 may be integrally formed. The home bar 125 may have the upper end and lower end respectively provided with panel supporting portions (not shown) for receiving the lower end of the first panel 122 and the upper end of the second panel 123 therein and supporting them. The first panel 122 and the second panel 123 are respectively implemented as transparent stiff members, for example, glass members in rectangular plate shapes.

The door main body 111 has the upper end and the lower end provided with an upper cover 151 and a lower cover 153 for respectively supporting the upper end and the lower end of the first panel 122 and the second panel 123.

The door main body 111 has both side surfaces to which the side cover 130 supporting both side portions of the first panel 122 and the second panel 123 is coupled. The side cover 130 includes a first side cover 131 disposed at a hinge portion side of the door main body 111 and a second side cover 141 disposed at an opposite side of the hinge portion. The first side cover 131 and the second side cover 141 are formed of a metallic member (e.g., aluminum) in a manner of pressing, etc.

As shown in FIGS. 4 and 5, the first side cover 131 includes a body 132 formed in a long plate shape so as to cover a side surface of the hinge portion side of the door main body 111, that is, a right side surface on the drawing, a plurality of front flanges 134 formed at the front surface of the body 132 so as to come into contact with a front surface portion of the outer case 112*a* of the door main body 111. Panel supporting portions 136 are respectively formed at each front side of the front flanges 134 so as to receive the side portions of the first panel 122 and the second panel 123 and support the panels 122, 123. That is, the panel supporting portions 136 are frontwardly spaced from the front flanges 134 to correspond to thickness of the first panel 122 and the second panel 123.

A curved portion 133 is formed at an end portion of a rear side of the body 132 in a curved shape so as to encompass a rear side edge of the door main body 111.

The front flanges 134 have end portions provided with curved end portions 139 curved toward the door main body 111. Accordingly, end portions of the front flanges 134 come into contact with the panels 122, 123 when the first panel 122 and the second panel 123 are slidably coupled to each other, thereby preventing the panels 122, 123 from being inferior by scratches. And, the curved end portions 139 come into contact with the door main body 111 first when the front flanges 134 are pressed backwardly, accordingly it is capable of preventing the front flanges 134 from being deformed toward the door main body 111.

Each front flange 134 is respectively provided with a screw coupling portion 135 and a screw hole 137 so that the first side cover 131 can be coupled to the door main body 111 by the screw 171.

Each screw coupling portion 135 is formed to be concaved from an external surface of the front flange 134 and to be protruded from an inner surface thereof so as to receive a head portion of the screw 171. Accordingly, the head portion of the screw 171 is received and is not protruded in a state that the thickness of the side cover 131 does not increase. Each screw coupling portion 135 is provided with the screw hole 137 by penetrating a plate surface so that each screw 171 can pass through the hole.

Each peripheral portion of the screw coupling portions 135 may be further provided with concaved portions 138 more concaved toward the door main body 111 than a contact surface of the front flange 134 coming into contact with the panels 122, 123. Accordingly, the head portion of the screws 171 received in the screw coupling portions 135 may be further spaced from the panels 122, 123 in a state that the screw coupling portions 135 are excessively deeper. Here, the screw coupling portions 135 may be formed in a pressing manner. And, the concaved portions 138 may be formed in a pressing manner or formed at a time of the pressing molding for the first side cover 131.

The door main body 111 is provided with an interference-avoiding space portion 115 concaved toward the inside of the outer case 112*a* so that each concaved portion 138 and screw coupling portion 135 can be received in the door main body 111 without interference. Female screw members 161 are formed at the rear side of the interference-avoiding space portion 115 so as to couple the screws 171 having passed through the screw holes 137 thereto.

As shown in FIG. 4, each female screw member 161 includes a body 163 having a female screw portion 165 therein, a coupling portion 166 formed at one end of the body 163 and having a square sectional surface so as to be coupled to the interference-avoiding space portion 115, and a rotation preventing portion 168 horizontally protruded with respect to an insertion direction of the screw 171. Accordingly, it is capable of preventing the female screw members 161 from rotating together with the screws 171 at the time of coupling process of the screws 171. Corresponding to this, the interference-avoiding space portions 115 are provided with receiving holes 117 formed in a square shape so as to receive the coupling portions 166 therein. Each coupling portion 166 may have a rear side provided with a flange 167 extended to come into contact with a rear surface of the interference-avoiding portion 115.

As shown in FIGS. 6 to 8, the second side cover 141 includes a body 142 formed in a long plate shape so as to cover the side surface portion of the door main body 111 and front flanges 144 formed at the front surface of the body 142 to come into contact with the front surface of the door main body 111. Panel supporting portions 146 are formed at each front side area of the front flanges 144 so as to receive side surfaces of the first panel 122 and the second panel 123 and support them. The panel supporting portions 146 are towardly spaced from the front flanges 144 by thickness of the first panel 122 and the second panel 123. The front flange 144 may be provided with a protrusion portion 148 protruded to contact with the first panel 122 or the second panel 123 so as to support the first panel 122 or the second panel 123.

A curved portion 143 may be formed at an end portion of a rear side of the body 142 of the second side cover 141 in a curved shape so as to encompass the rear edge of the door main body 111. Screw coupling portions 145 are formed on a plate surface of the body 142 so as to be coupled to the side surface portions of the door main body 111 by the screw 171. The screw coupling portions 145 are formed to be concaved from the external surface of the body 142 and protruded from the inner surface thereof so as to receive each head portion of the screws 171 without increasing the thickness of the body 145. Each screw coupling portion 145 is respectively provided with a screw hole 147 penetratingly formed so that the screw 171 can pass therethrough.

Corresponding to this, door main body 111 has the side surface portion provided with the interference-avoiding space portion 115 inwardly concaved so that each screw coupling portion 145 can be coupled without interference. The female screw members 161 are formed at the rear side of the interference-avoiding space portions 115 so as to couple the screws 171 thereto.

Each female screw member 161 includes the body 163 having the female screw portion 165 therein, the coupling portion 166 formed at one end of the body 163 and having the square sectional surface so as to be coupled to the interference-avoiding space portion 115, and the rotation preventing portion 168 horizontally protruded with respect to the insertion direction of the screw 171. Corresponding to this, the interference-avoiding space portions 115 are provided with the receiving holes 117 formed in the square shape so as to receive the coupling portions 166 therein. Each female screw member 161 is further provided with the flange 167 extended more than the coupling portion 166 so as to come into contact with the rear surface of the interference-avoiding space portion 115.

With such configuration, the first side cover 131 is disposed at the side surface portion of the hinge portion side of the door main body 111 so that each screw coupling portion 135 of the first side cover 131 may be respectively received in the corresponding interference-avoiding portion 115 of the door main body 111, first. And then, each screw 171 is inserted into corresponding screw hole 137, accordingly the first side cover 131 is fixed at the door main body 111.

The first panel 122 and the second panel 123 are slidably coupled to the door main body 111 along a direction of the plate surface of the door main body 111 so that the first panel 122 and the second panel 123 may be supported by the home bar 125 and the first side cover 131. Here, the screw coupling portions 135 and the concaved portions 138 of the first side cover 131 are configured that the head portions of the screws 171 are to be spaced from the rear surfaces of the panels 122, 123, accordingly it is capable of preventing scratches of the panels 122, 123 due to the head portions of the screws 171 at the time of slidable coupling of the panels 122, 123.

Then, the upper cover 151 and the lower cover 153 are respectively coupled to the upper end and the lower end of the door main body 111, and the second side cover 141 is disposed at the opposite side of the hinge portion of the door main body 111 so that each screw coupling portion 145 of the second side cover 141 may be received inside of the corresponding interference-avoiding portion 115. Then, each screw 171 is inserted into the corresponding screw hole 147 so that the second side cover 141 may be coupled to the door main body 111.

So far, a specific embodiment of the present invention is illustrated and explained. However, as the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A door assembly comprising:

a door main body;

a panel disposed on a front surface of the door main body; and a side cover coupled to at least one of a left side portion and a right side portion of the door main body and supporting the panel, wherein the side cover is provided with screw coupling portions concaved from an external surface and protruded from an inner surface along an insertion direction of screws and screw holes formed by penetrating the screw coupling portions, wherein the door main body is provided with inference-avoiding space portions for receiving the screw coupling portions therein, wherein the door main body comprises female screw members disposed at each rear side of the interference-avoiding space portions and to which the screws are coupled, and wherein the female screw members are respectively provided with coupling portions so as to be coupled to the interference-avoiding space portions, and the interference-avoiding space portions are respectively provided with receiving holes so as to receive the coupling portions.

2. The door assembly of claim 1, wherein the female screw members are respectively provided with at least one rotation preventing portion protruded in a horizontal direction with respect to an axial line direction.

3. The door assembly of claim 1, wherein the female screw members are respectively provided with flanges coming into contact with each rear surface of the interference-avoiding space portions.

4. The door assembly of claim 1, wherein the side cover comprises a first side cover disposed at a side surface portion of a hinge portion side of the door main body and a second side cover disposed at an opposite side of the first side cover.

5. The door assembly of claim 4, wherein the first side cover is provided with front flanges disposed on the front surface of the door main body.

6. The door assembly of claim 5, wherein the screw coupling portions are formed at the front flanges.

7. The door assembly of claim 5, wherein the front flanges are configured to have end portions curved toward the door main body.

8. The door assembly of claim 5, wherein the first side cover is provided with panel supporting portions disposed at each front side of the front flange and supporting the panel.

9. The door assembly of claim 4, wherein the second side cover comprises a body disposed at the side surface portion of the door main body and front flanges disposed on the front surface of the door main body, wherein the screw coupling portions are formed at the body.

10. The door assembly of claim 9, wherein the second side cover is provided with panel supporting portions disposed at the front side of the front flanges and supporting the panel.

11. The door assembly of claim 1, wherein the side cover is formed of a metallic member.

12. The door assembly of claim 11, wherein the screw coupling portions are formed in a pressing manner.

13. The door assembly of claim 11, wherein the side cover is formed in an extruding manner.

14. The door assembly of claim 1, wherein the screw coupling portions are formed at concaved portions more concaved toward the door main body than peripheral portions thereof.

15. A refrigerator having a door assembly, the refrigerator comprising:

a refrigerator main body having a cooling chamber therein; and the door assembly of claim 1 disposed on a front surface of the refrigerator main body so as to open and close the cooling chamber.

* * * * *